United States Patent [19]

Sasso

[11] Patent Number: 4,524,971

[45] Date of Patent: Jun. 25, 1985

[54] TWO DIMENSIONAL PUZZLE

[76] Inventor: Albert Sasso, 8 Rall Ct., Roseland, N.J. 07608

[21] Appl. No.: 445,898

[22] Filed: Dec. 1, 1982

[51] Int. Cl.[3] ..... A63F 9/08

[52] U.S. Cl. ..... 273/153 S; 273/281

[58] Field of Search ..... 273/153 S, 281

[56] References Cited

U.S. PATENT DOCUMENTS

| | | | |
|---|---|---|---|
| 427,392 | 5/1890 | Bradshaw | 273/153 S |
| 1,101,567 | 6/1914 | Ridgway | 273/153 S |
| 1,538,768 | 5/1925 | Wheaton | 273/153 S X |
| 4,402,510 | 9/1983 | Yokoi | 273/153 S |
| 4,412,681 | 11/1983 | Irwin | 273/153 S |
| 4,480,839 | 11/1984 | Waters | 273/258 |

FOREIGN PATENT DOCUMENTS

| | | | |
|---|---|---|---|
| 3039513 | 5/1982 | Fed. Rep. of Germany | 273/153 S |
| WO82/00772 | 3/1982 | PCT Int'l Appl. | 273/153 S |
| 2096904 | 9/1982 | United Kingdom | 273/153 S |

*Primary Examiner*—Anton O. Oechsle

*Attorney, Agent, or Firm*—Anthony F. Cuoco

[57] ABSTRACT

A two dimensional puzzle is disclosed which includes a plurality of interlocking movable pieces carrying indicia and disposed on a planar board. The pieces remain interlocked while being moved independently in at least two directions across the board. The arrangement is such that the pieces can be moved only in sets including a predetermined number of pieces. By successive movements of different sets of pieces any single piece of any set can be positioned at any point on the board. By moving one piece of a set into position other pieces in the set will be moved out of position so as to impart puzzle characteristics to the invention. The puzzle is solved by moving the pieces across the board to satisfy predetermined indicia patterns.

15 Claims, 24 Drawing Figures

TWO DIMENSIONAL PUZZLE

BACKGROUND OF THE INVENTION

Puzzles which challenge the intellectual capacity of a user are of rapidly growing interest and popularity. Most notable among these are the three dimensional puzzles such as the several varieties of puzzles in the form of regular solids (the cubic puzzles, for example) which have been developed and marketed.

Planar or two dimensional puzzles have the potential of presenting a like challenge in their solution and are also gaining in interest and popularity. In puzzles of this type a planar board is provided and pieces carrying indicia such as colors, numbers or symbols are moved on the board. The solution to the puzzle lies in moving the pieces to provide a predetermined indicia pattern. Puzzles of this type have the advantage of a certain degree of familiarity to the user in that they resemble in form the well known board games. By arranging the shape of the movable pieces, their relative positions on the board and the movements which may be made, the solution to these puzzles can present challenges of various degrees of complexity.

Accordingly, it is the object of this invention to provide a two dimensional puzzle including a planar board and a plurality of pieces carrying indicia and movable on the board, whereby the solution to the puzzle lies in moving the pieces to satisfy predetermined indicia patterns.

SUMMARY OF THE INVENTION

This invention contemplates a two dimensional puzzle including a plurality of interlocking movable pieces carrying indicia and disposed on a planar board. The movable pieces are in the shape of a regular polygon and the shape of the board is varied to accommodate movement of the pieces. The pieces remain interlocked while being moved on the board. As the number of sides of the regular polygon pieces increases, the number of possible directions of the movement of the pieces increases. In general, the number of directions of movement corresponds to the number of non-parallel sides (or pairs of non-parallel sides) of the movable pieces. The pieces are movable in sets including a predetermined number of pieces. By successive movements of different sets any single piece of any set can be positioned on the board. The puzzle is solved by moving the pieces on the board to satisfy predetermined indicia patterns. Puzzles are possible wherein the movable pieces are of more than one shape and planar boards can be linked to create larger and more difficult puzzles.

DESCRIPTION OF THE DRAWINGS

FIGS. 6–7 are diagrammatic representations illustrating a structural relationship wherein the movable pieces are retained on the board under conditions of tilting of the board or the like.

DESCRIPTION OF THE INVENTION

Figure 1:
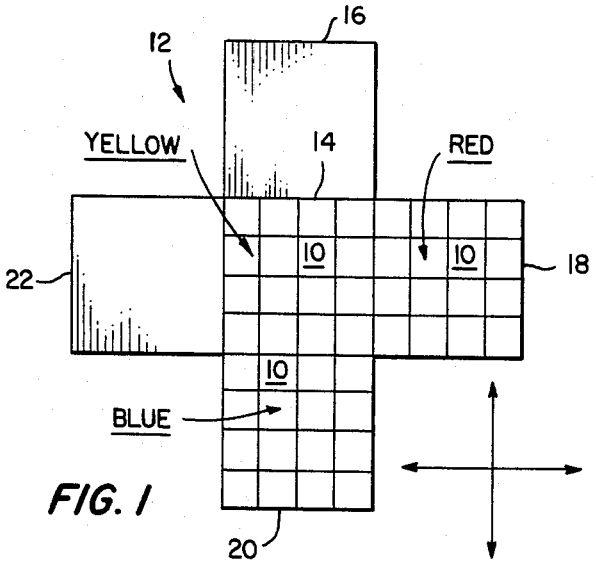
FIG. 1 is a diagrammatic representation of one form of the invention including interlocking movable pieces arranged on a planar board, said movable pieces carrying colored indicia.

In the form of the invention shown in FIGS. 1–17 the puzzle includes square shaped movable pieces 10 of three different colors. There are sixteen square shaped pieces 10 of each color (forty-eight total pieces) arranged on a planar board 12. Board 12 is defined by a large center square 14, with four large squares 16, 18, 20, 22 of the same size as square 14 and having a side common therewith. Each of the squares 14, 16, 18, 20, 22 is large enough to hold sixteen movable pieces 10, with the pieces shown disposed on squares 14, 18 and 20. For purposes of example the pieces on square 14 may be yellow, the pieces on square 18 red; and the pieces on square 20 blue, as shown in the Figure.

Figure 2:
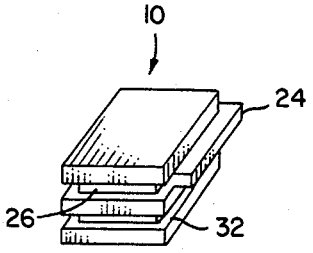
FIG. 2 is a isometric diagrammatic representation illustrating the interlocking feature of the movable pieces shown in FIG. 1.

Movable pieces 10 are interlocked by a tongue 24 and groove 26 arrangement on each of the pieces as shown in FIG. 2. This allows pieces 10 to remain interlocked while being moved independently in the two mutually perpendicular directions across board 12 as shown by the arrows in FIG. 1 and as will hereinafter be more fully explained.

Figure 3:
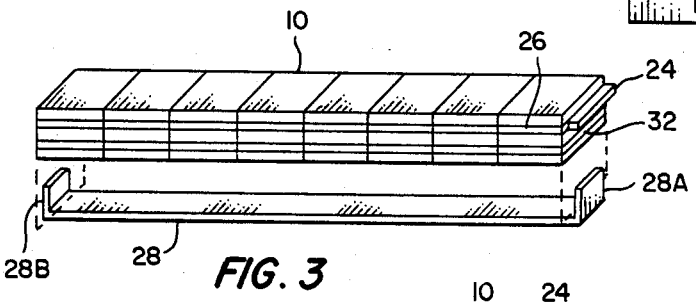
FIG. 3 is an isometric diagrammatic representation showing a structural arrangement wherein the movable pieces of FIG. 1 are retained in sets of a predetermined number of pieces.

Pieces 10 are movable only in sets of eight. As shown in FIG. 3, this is accomplished by a generally U-shaped retaining member 28 which retains each straight line set of eight pieces 10 between its sides 28A and 28B. By successive movements of different sets of eight pieces 10, any single piece 10 of any set can be positioned at any point on board 12. By moving one piece into position, other pieces in the set will be moved out of position. This gives the invention its puzzle characteristics. The puzzle is solved by moving pieces 10 across playing board 12 to satisfy specific color patterns.

Figure 4:
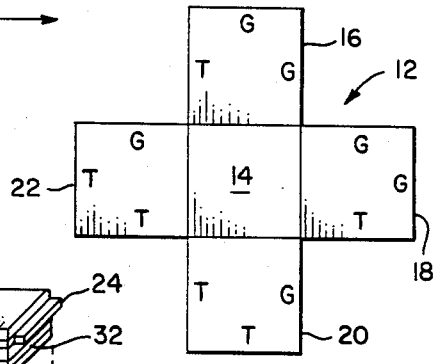
FIG. 4 is a diagrammatic representation illustrating a structural feature of the playing board.

As shown in FIG. 4, where "T" signifies tongue and "G" signifies groove, the edges of board 12, i.e. the edges of squares 16, 18, 20 and 22, which are not common with the edges of square 14, carry tongues and grooves and are compatible with the tongue and groove arrangement of movable pieces 10.

Board 12 may be of a suitable plastic material. Members 28 which retain movable pieces 10 in straight lines sets of eight may likewise be of plastic.

Figure 5:
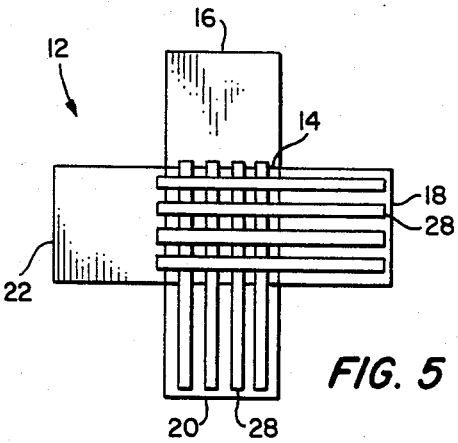
FIG. 5 is a diagrammatic representation illustrating the structural relationship between the planar board and members for retaining the pieces in sets.

There are four retaining members 28 for moving sets of pieces 10 in one direction and four retaining members 28 for moving sets of pieces 10 in a direction perpendicular to the one direction as shown in FIG. 5. Board 12 is constructed so that the four retaining members in the one direction overlay the four retaining members in the perpendicular direction (FIG. 5). This allows each upper and lower set of retaining members 28 to move independently. Members 28 which move across board 12 are also made of a suitable plastic material.

Figure 6:
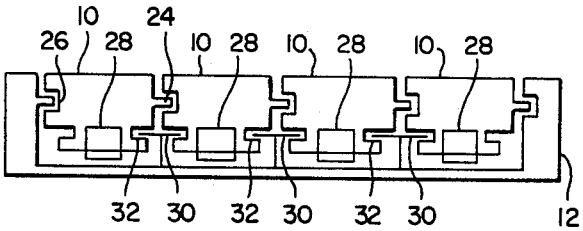

As retaining members 28 move in the directions shown by the arrows in FIG. 1, pieces 10 will move in straight line sets of eight. Pieces 10 which are positioned on the outer four squares 16, 18, 20 and 22 of board 12 are held in place by rails 30 which are rigidly secured to the board and which interlock with grooves 32 at the bottom of pieces 10 (see FIG. 2) as shown in FIG. 6. Rails 30 are required only for the four outer squares 16, 18, 20 and 22 and will hold pieces 10 in place if board 12 is tilted as will now be understood with reference to FIG. 6.

Figure 7:
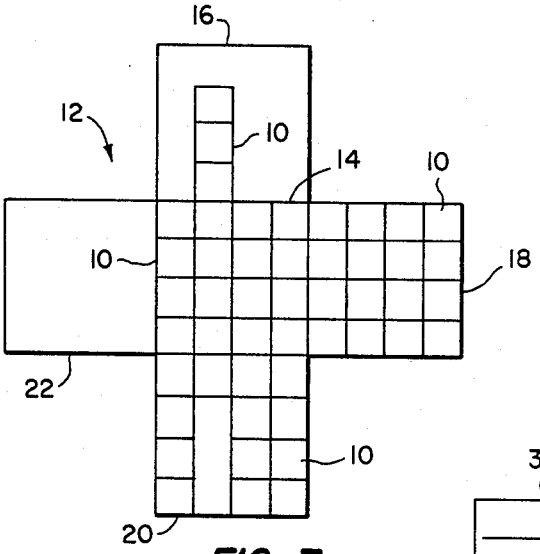

Thus, with pieces 10 arranged as shown, for example, in FIG. 7, there are no adjacent pieces to hold an isolated set of eight pieces by the aforenoted tongue and groove arrangement. Hence rails 30 are necessary to secure the movable pieces in the arrangement shown in the Figure and in similar arrangements.

It will be understood that central square 14 does not require rails 30 and, indeed, their existence thereon would make movement of retaining members 28 in perpendicular directions impossible.

It is to be noted that while it is impossible to isolate sets of movable pieces 10 on central square 14, it is possible to isolate said pieces on outer squares 16, 18, 20 and 22 (FIG. 7). Hence, any single movable piece 10 of any set of eight can be positioned at any point on the board by succesive movements of the sets of pieces in mutally perpendicular directions. There are eight movable pieces to a set, as defined by retaining members 28, but in moving the pieces across the board each set includes a different combination of pieces.

Figure 8:
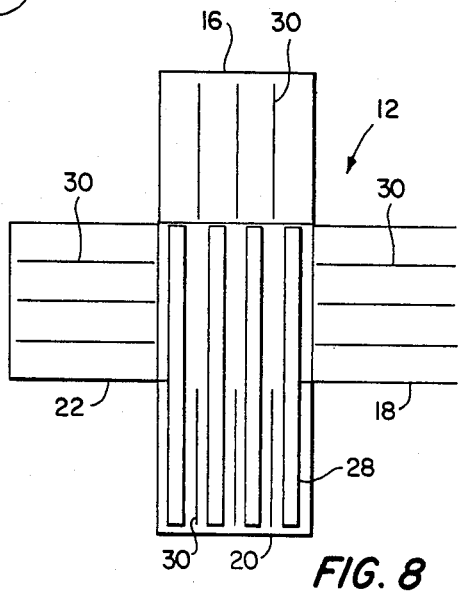
FIGS. 8–11 are diagrammatic representations illustrating various stages in the construction of the form of the invention shown in FIG. 1, with FIG. 11 being an isometric diagrammation representation.
Figure 9:
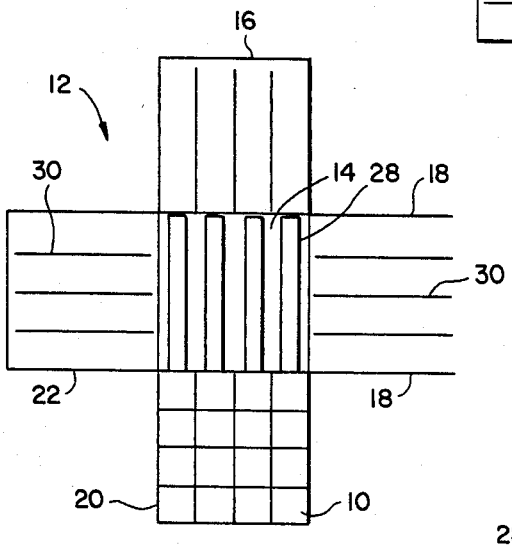
Figure 10:
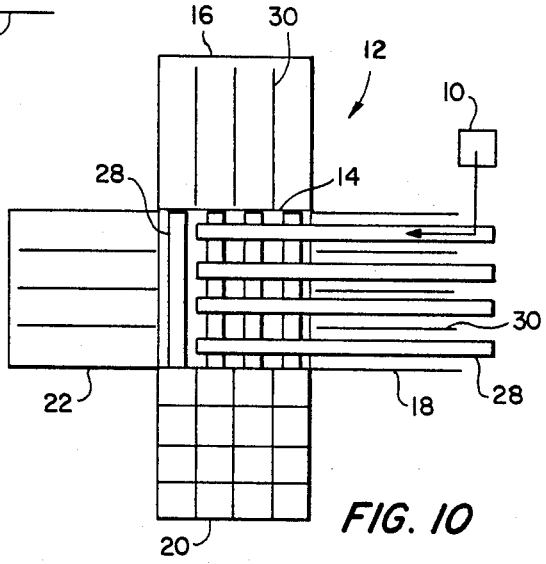

In constructing the puzzle of the invention, planar board 12 is arranged to have rails 30 on outer squares 16, 18, 20 and 22 and extending inwardly of the squares as shown in FIG. 8, and tongue and groove edges as heretofore described. Board 12 is made with one edge, such as on square 18, missing to enable movable pieces 10 to be inserted onto the board (FIG. 8). Forty-eight movable pieces are made with tongue and groove edges to be compatible with rails 30 as heretofore described. Colored decals are applied to three groups of sixteen pieces each i.e., a different color decal for each group. With further reference to FIG. 8, four of eight retaining members 28 (lower) are disposed in parallel between rails 30 on a square such as 20. Sixteen movable pieces 10 are positioned by sliding adjacent pieces into place on the rails over the retaining members on square 20 of the board, while observing the correct tongue and groove orientation (FIG. 9). The remaining four retaining members 28 (upper) overlay the lower four retaining members 28 between respective rails 30 as indicated in FIG. 10. This allows the remaining thirty-two movable pieces 10 to be placed in position by sliding them onto rails 30 and interlocking the tongue and groove edges of the pieces with the edge of board 12 as also indicated in FIG. 10.

Figure 11:
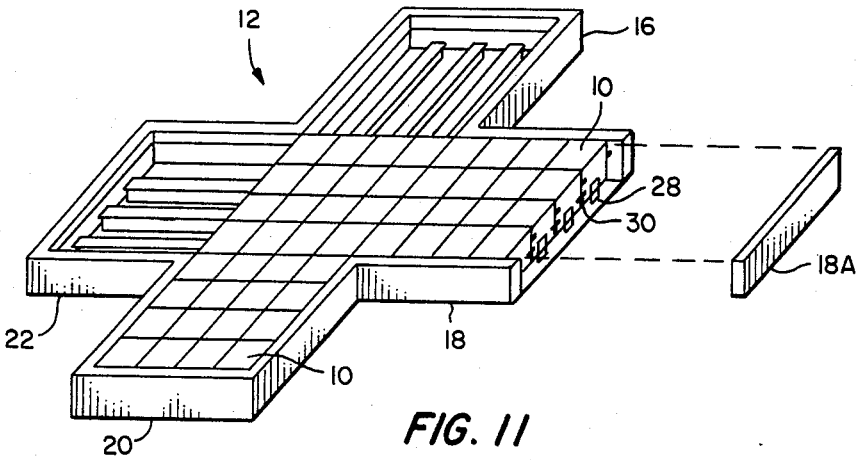

As pieces 10 fill retaining members 28, the ends of the retaining members are pushed completely into board 12 and the missing edge 18A of the board is suitably secured. All retaining members 28 and movable pieces 10 are now in working positions and pieces 10 are held in place on the board by the described tongue and groove arrangement and rails 30 as shown in FIG. 11. The retaining members are free to slide between the rails and carry the sets of eight movable pieces 10 with them.

In view of the aforenoted description of the invention, the puzzle is solved by moving straight line retained sets of eight movable pieces 10 in two mutually perpendicular directions as aforenoted. By successive moves, any piece 10 can be positioned at any point on board 12. The movable pieces will move within different sets of eight pieces with each move of a different retaining member 28 until a desired position of the pieces is reached to solve the puzzle.

Figure 12:
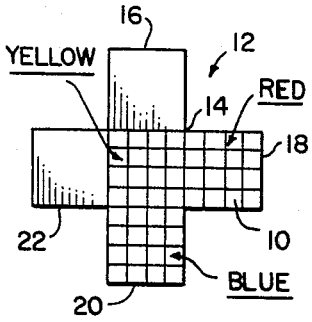
FIG. 12 is a diagrammatic representation typically illustrating an initial position of the movable pieces on the board for the form of the invention shown in FIG. 1.
Figure 13:
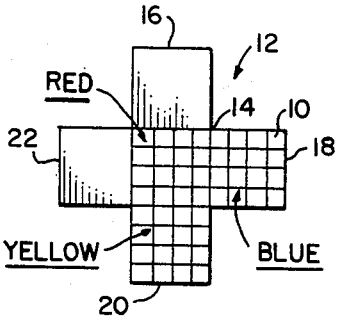
FIGS. 13–14 are diagrammatic representations illustrating typical solutions of the form of the puzzle shown in FIG. 1.
Figure 14:
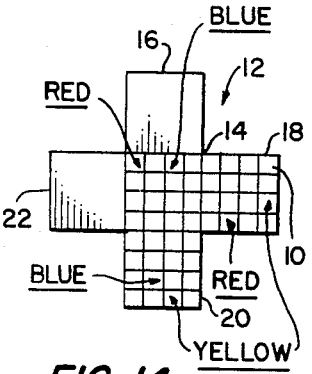

The solution to the puzzle can be, for example, any predetermined color pattern of movable pieces on the planar board that the user chooses. The movable pieces are moved across the board until the color pattern is achieved. In moving some pieces into position, other pieces will be moved out of position. Since the pieces must be moved simultaneous in a set, this makes the solution of the puzzle a challenging effort. Examples of puzzle solutions are shown in FIGS. 13 and 14, wherein groups of eight or sixteen pieces 10 are colored red, blue and yellow as indicated. The solutions are achieved by moving the pieces from an original position on board 12 which is shown in FIG. 12 and wherein all of the pieces on any one square are of the same color.

Figure 15:
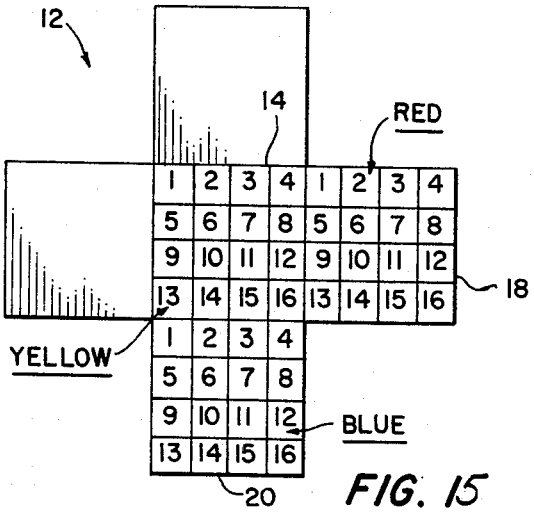
FIG. 15 is a diagrammatic representation of the form of the invention shown in FIG. 1, wherein the movable pieces carry numerical as well as colored indicia.

A variation of the described color indicia carried by pieces 10 is now evident. Thus, each color set of pieces 10 can be numbered with consecutive integers 1, 2, 3, - - - 16 as shown in FIG. 15. Each piece 10 of each color set (yellow on square 14, red on square 18, and blue on square 20) is thus given a unique position on board 12 by virtue of its number sequence as well as by its color designation. In this manner the difficulty of the puzzle's solution is increased, as may be desirable.

It will now be understood with reference to the invention as heretofore described that puzzles of similar shape, structure and solution can be developed.

Figure 16:
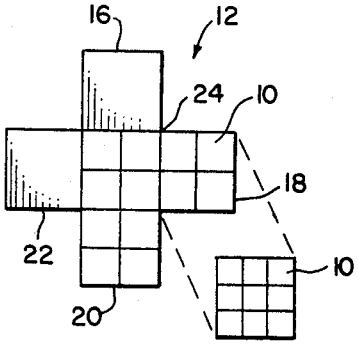
FIGS. 16–17 are diagrammatic representations illustrating variations in the form of the invention shown in FIG. 1.
Figure 17:
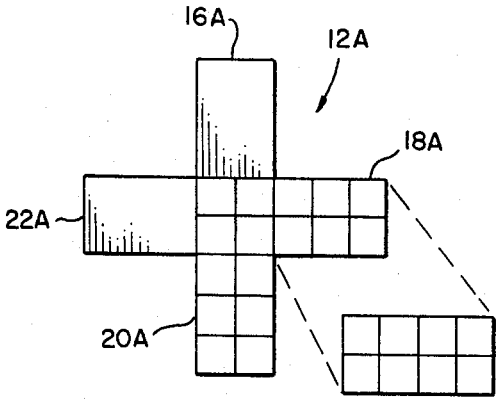

The number of movable pieces as well as the shape of the planar board can vary. As long as one direction of movement of the pieces is perpendicular to the other direction of movement and the central portion of the board is always completely filled with movable pieces, any square or rectangular shaped board using square shaped pieces will satisfy the described purposes. If a square shaped board is used the number of movable pieces on the board squares can vary as best illustrated in FIG. 16. A rectangular shaped playing board 12A can also be used and the number of square shaped movable pices 10 can also vary as best illustrated in FIG. 17.

Figure 19:
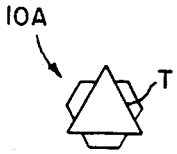
FIGS. 18–23 are diagrammatic representations illustrating other forms of the invention.
Figure 20:
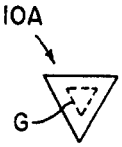
Figure 18:
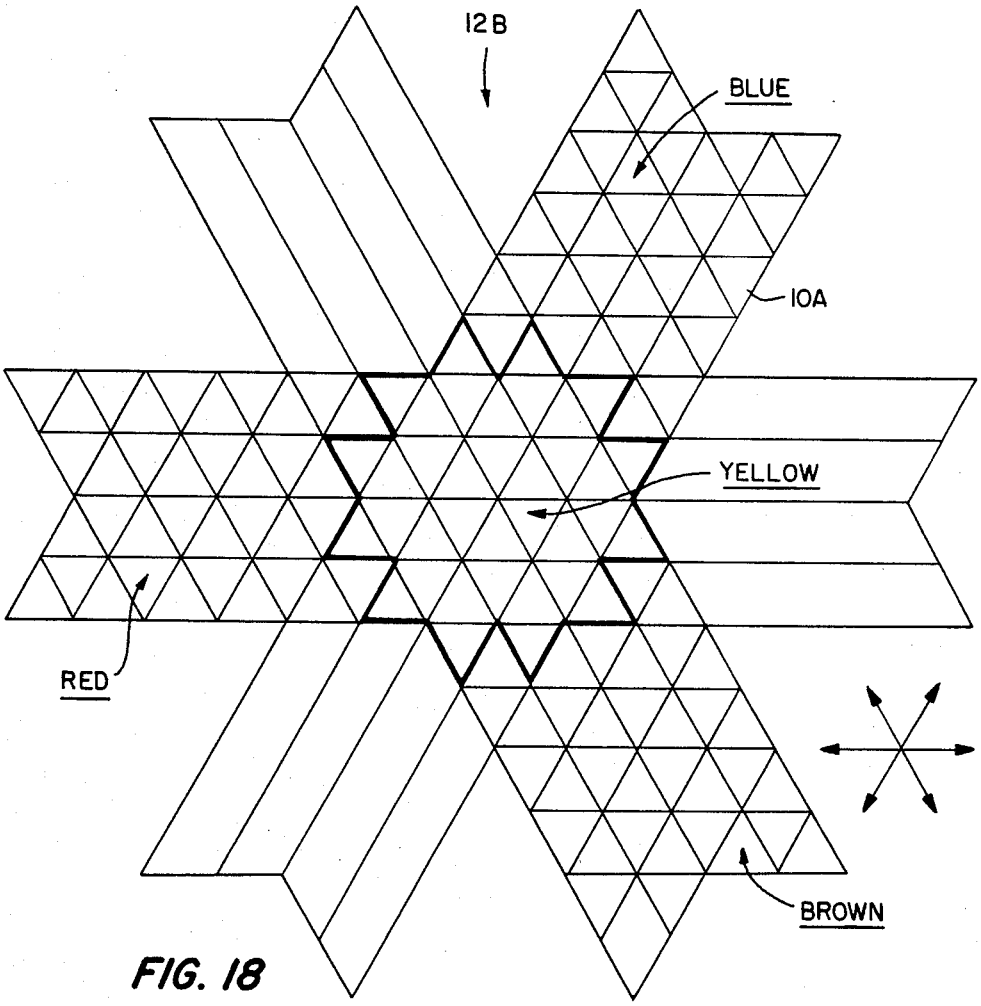

It will be understood that puzzles of analogous structure and solution can be made by using, for example, the geometrical characteristics of an equilateral triangle. In this event, the planar board, designated as 12B in FIG. 18, is shaped so that three arms of four rows each intersect to form a symmetrical six arm cross. The movable pieces designated as 10A are equilateral triangles which either point "up" or point "down". The "up" pieces carry tongues (T) and the "down" pieces carry grooves (G) as shown in FIGS. 19 and 20 respectively. These pieces remain in either "up" or "down" orientation wherever they are moved on the board, which is in three directions corresponding to the directions of the arms as shown by the arrows (FIG. 18).

Figure 21:
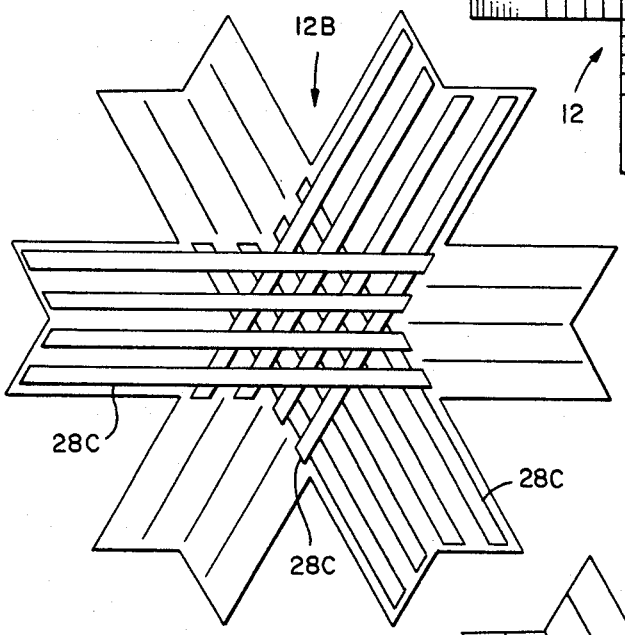
Figure 22:
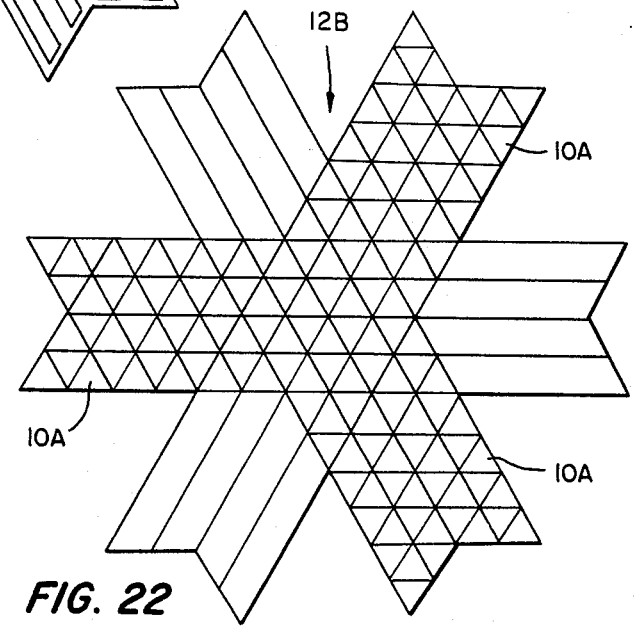

There are three levels of retaining members 28C which pass over each other, with each level having four members as shown in FIG. 21. Each retaining member 28C contains seventeen or nineteen triangular shaped pieces 10A, as the case may be, which make up a straight line set as shown in FIG. 22. Each set has "up" and "down" pieces as aforenoted. The pieces are moved in seventeen or nineteen piece sets in three directions. By successive moves each triangular shaped movable piece 10A can be positioned at any point on board 12B. The puzzle is solved by moving the pieces 10A across board 12B and using any predetermined color pattern as a solution. There are four colors used in the puzzle (i.e., yellow, red, blue and brown) with the colors in a pattern on the arms of the cross as shown in FIG. 18. The exchanges of positions of two colors, three colors, and four colors are the most obvious color pattern solutions to the puzzle as illustrated in FIG. 18 and as will now be understood.

Other puzzles can be made using triangular shaped movable pieces by varying, in a similar way to that described for the square shaped pieces, the shape of the board and the number of triangular shaped pieces used as will also be understood.

Numbering of the pieces of each color set, similar to the numbering of the square shaped pieces, will make the solution to the puzzle more difficult as may be desired.

Similar puzzles are possible using other regular polygon shaped movable pieces and varying the shape of the playing board to accommodate these pieces. As the number of sides of the regular polygon pieces increases, the number of possible directions of movement of said pieces increases. For example, the square shaped piece has been shown to move in two perpendicular directions (FIG. 1). A triangular piece can be moved in three directions as shown by the arrows in FIG. 18. In general, the number of directions that the pieces move is equal to the number of non-parallel sides (or pairs of sides) of the movable pieces.

Figure 23:
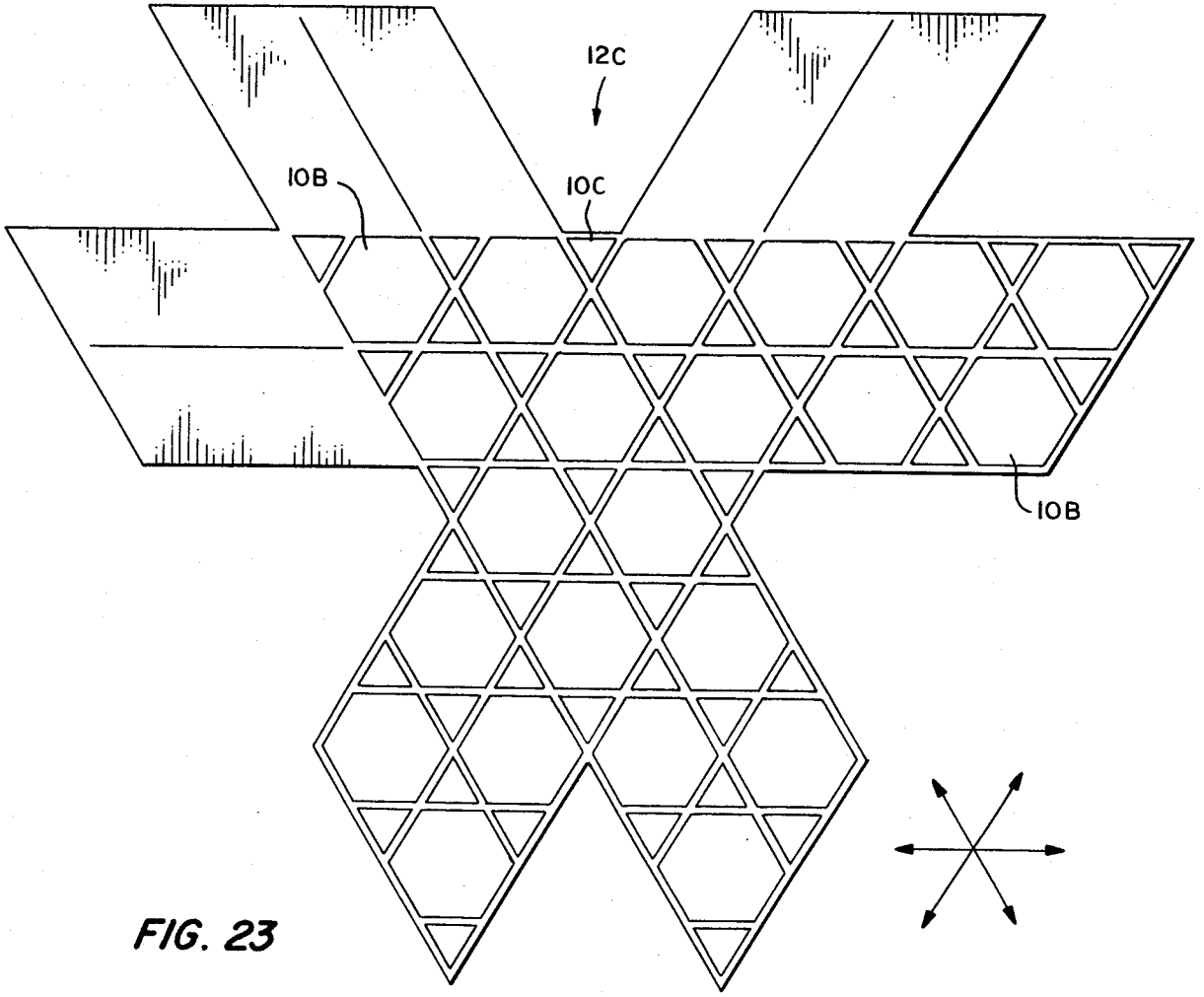

Puzzles are also possible which make use of more than one shape of movable pieces. One example shown in FIG. 23 makes use of the hexagon 10B and triangle 10C in a puzzle configuration with three directions of movement as shown by the arrows, as will be understood from the aforegoing. In FIG. 23 the planar board is formed by three intersecting arms forming an assymetrical six arm cross.

Figure 24:
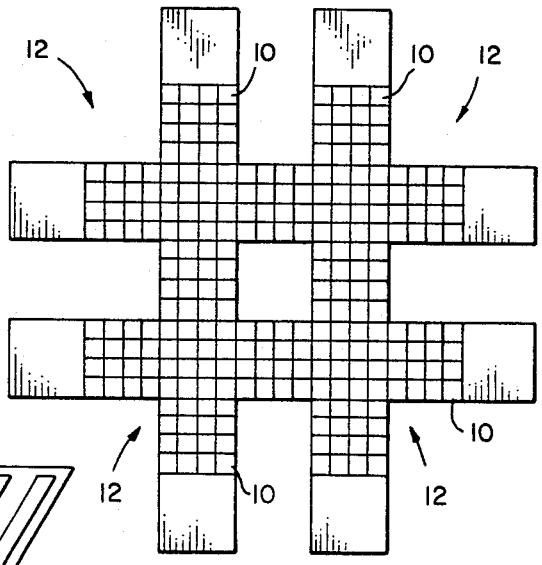
FIG. 24 is a diagrammatic representation illustrating a form of the invention wherein planar boards are linked to create a larger and more complex puzzle.

Planar boards can be linked in sets to create larger and more difficult puzzles. Examples for the square shaped piece puzzles are the most obvious as shown in FIG. 24 wherein four boards 12 carrying movable pieces 10 are so linked. Similar linked sets of boards are possible for all puzzles using different shaped pieces.

The movable pieces can be labeled by use of colors and numbers, as previously described or by any other indicia which makes their correct position on the board unique. For the square shaped piece puzzle, for example, each set of sixteen pieces could be covered by a different design, picture or symbol which would give the pieces different labels and thus a unique correct position and a unique puzzle solution.

Having thus described the invention, what is claimed is:

1. A two dimensional puzzle, comprising:

a planar board defined by a centrally disposed relatively large square and four squares of the same size as the centrally disposed square, each of the four squares having an edge common with an edge of the centrally disposed square;

a plurality of movable pieces carrying indicia and disposed on the planar board, said pieces being relatively small squares, each of the same size and initially positioned in equal numbers on the centrally disposed square and two of the four squares to fill said squares;

means for retaining the movable pieces in a plurality of sets each of which includes a predetermined number of pieces, with the pieces movable only in the sets on the planar board, with successive movements of the sets positioning any piece of any set at any point on the planar board;

the pieces being moved in the sets of a predetermined number of pieces in two mutually perpendicular directions on the planar board; and the sets being successively moved on the planar board with the pieces retained in the sets until a predetermined indicia pattern is achieved.

2. A two dimensional puzzle as described by claim 1, wherein:

a plurality of sets of pieces are movable in one direction;

another plurality of sets of pieces are movable in another direction; and the retaining means of the plurality of sets of pieces movable in the one direction overlay the retaining means of the plurality of sets of pieces movable in the other direction.

3. A two dimensional puzzle as described by claim 1, including;

means for retaining the movable pieces on the planar board.

4. A two dimensional puzzle as described by claim 3, wherein the means for retaining the movable pieces on the planar board includes:

a plurality of rails carried by the board and extending inwardly from the edges thereof;

grooves carried by the movable pieces;

the rails engaging the grooves for retaining the pieces on the planar board; and the retaining means for retaining the movable pieces in a plurality of sets are slidable with the pieces retained thereby between the rails.

5. A two dimensional puzzle as described by claim 1, wherein:

the predetermined number of pieces are arranged in a plurality of straight line sets;

each straight line set of pieces always contains the same predetermined number of pieces; and in moving the pieces on the planar board each set includes a different combination of pieces.

6. A two dimensional puzzle, comprising:

a planar board defined by three relatively long arms of equal length extending in three different directions so as to intersect and to form a symmetrical six arm cross;

a plurality of movable pieces carrying indicia and disposed on the planar board, said pieces being relatively small equilateral triangles positioned on the arms in predetermined patterns in three different directions;

means for retaining the movable pieces in a plurality of sets each of which includes a predetermined number of pieces, with the pieces movable only in the sets on the planar board, with successive movements of the sets positioning any piece of any set at any point on the planar board;

the pieces being moved in the sets of a predetermined number of pieces in the three different directions on the planar board; and the sets being successively moved on the planar board with the pieces retained in the sets until a predetermined indicia pattern is achieved.

7. A two dimensional puzzle as described by claim 6, wherein:

a plurality of sets of pieces are movable in one direction;

another plurality of sets of pieces are movable in another direction; and the retaining means of the plurality of sets of pieces movable in the one direction overlay the retaining means of the plurality of sets of pieces movable in the other direction.

8. A two dimensional puzzle as described by claim 6, including:

means for retaining the movable pieces on the planar board.

9. A two dimensional puzzle as described by claim 8, wherein the means for retaining the movable pieces on the planar board includes:

a plurality of rails carried by the board and extending inwardly from the edges thereof;

grooves carried by the movable pieces;

the rails engaging the grooves for retaining the pieces on the planar board; and the retaining means for retaining the movable pieces in a plurality of sets slidable with the pieces retained thereby between the rails.

10. A two dimensional puzzle as described by claim 6, wherein:

the predetermined number of pieces are arranged in a plurality of straight line sets;

each straight line set of pieces always contains the same predetermined number of pieces; and in moving the pieces on the planar board each set includes a different combination of pieces.

11. A two dimensional puzzle, comprising:

a planar board defined by three relatively long arms of equal length extending in three different directions so as to intersect and to form an asymmetrical six arm cross;

a plurality of movable pieces carrying indicia and disposed on the planar board, said pieces being relatively small regular hexagons and equilateral triangles positioned on the arms in predetermined patterns in the three different directions;

means for retaining the movable pieces in a plurality of sets each of which includes a predetermined number of pieces, with the pieces movable only in the sets on the planar board, with successive movements of the sets positioning any piece of any set at any point on the planar board;

the pieces moved in the sets of a predetermined number of pieces in the three different directions; and the sets being successively moved on the planar board with the pieces retained in the sets until a predetermined indicia pattern is achieved.

12. A two dimensional puzzle as described by claim 11, wherein:

a plurality of sets of pieces are movable in one direction;

another plurality of sets of pieces are movable in another direction; and the retaining means of the plurality of sets of pieces movable in the one direction overlay the retaining means of the plurality of sets of pieces movable in the other direction; and the retaining means of the plurality of sets of pieces movable in the one direction overlay the retaining means of the plurality of sets of pieces movable in the other direction.

13. A two dimensional puzzle as described by claim 11, including:

means for retaining the movable pieces on the planar board.

14. A two dimensional puzzle as described by claim 13, wherein the means for retaining the movable pieces on the planar board includes:

a plurality of rails carried by the board and extending inwardly from the edges thereof;

grooves carried by the movable pieces;

the rails engaging the grooves for retaining the pieces on the planar board; and the retaining means for retaining the movable pieces in a plurality of sets are slidable with the pieces retained thereby between the rails.

15. A two dimensional puzzle as described by claim 11, wherein:

the predetermined number of pieces are arranged in a plurality of straight line sets;

each straight line set of pieces always contains the same predetermined number of pieces; and in moving the pieces on the planar board each set includes a different combination of pieces.

* * * * *